US007467490B2

(12) United States Patent
Mossberg et al.

(10) Patent No.: US 7,467,490 B2
(45) Date of Patent: Dec. 23, 2008

(54) DISPLAY CLAMP ASSEMBLY FOR EXTRA FIREARM BARRELS

(75) Inventors: Alan I. Mossberg, Tierra Verde, FL (US); Vincent Juchniewicz, Berlin, CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 413 days.

(21) Appl. No.: 10/908,349

(22) Filed: May 9, 2005

(65) Prior Publication Data

US 2006/0179701 A1 Aug. 17, 2006

Related U.S. Application Data

(60) Provisional application No. 60/652,715, filed on Feb. 14, 2005.

(51) Int. Cl.
*F41A 21/06* (2006.01)

(52) U.S. Cl. ..... 42/77

(58) Field of Classification Search ..... 42/77, 42/146

See application file for complete search history.

(56) References Cited

U.S. PATENT DOCUMENTS

| | | | | | |
|---|---|---|---|---|---|
| 1,535,459 | A | * | 4/1925 | Fredrickson | 362/113 |
| 2,073,755 | A | * | 3/1937 | Poate | 42/1.06 |
| 2,426,479 | A | * | 8/1947 | Wohlhieter | 248/74.3 |
| 3,235,967 | A | * | 2/1966 | Moure et al. | 42/122 |
| 3,766,677 | A | * | 10/1973 | Waddell | 42/75.04 |
| 4,139,100 | A | * | 2/1979 | Reed | 211/4 |
| 4,195,432 | A | * | 4/1980 | Hickman | 42/106 |
| 4,542,447 | A | | 9/1985 | Quakenbush | |
| 4,603,497 | A | * | 8/1986 | Crimmins, Jr. | 42/106 |
| 4,756,111 | A | * | 7/1988 | Lapier | 42/128 |
| 4,894,941 | A | | 1/1990 | Karow, Jr. | |
| 4,989,359 | A | * | 2/1991 | Kinkner et al. | 42/77 |
| 5,033,219 | A | * | 7/1991 | Johnson et al. | 42/115 |
| 5,284,110 | A | * | 2/1994 | Hostetler | 119/72 |
| 5,344,032 | A | * | 9/1994 | Ramsdell | 211/64 |
| 5,471,777 | A | * | 12/1995 | McDonald | 42/132 |
| 5,769,556 | A | * | 6/1998 | Colley | 403/24 |
| 5,913,669 | A | * | 6/1999 | Hansen et al. | 42/146 |
| 6,115,952 | A | * | 9/2000 | Rigler | 42/146 |
| 6,935,065 | B1 | * | 8/2005 | Oliver | 42/94 |
| 2003/0025048 | A1 | * | 2/2003 | Knotts | 248/68.1 |
| 2006/0026888 | A1 | * | 2/2006 | Cheng et al. | 42/146 |

* cited by examiner

*Primary Examiner*—Troy Chambers
(74) *Attorney, Agent, or Firm*—Holland & Bonzagni, P.C.; Donald S. Holland, Esq.

(57) ABSTRACT

A display clamp assembly, and a related method, are disclosed for removably attaching a second barrel to a shotgun for display purposes, allowing a retail store (or a buyer) to display the firearm as a combination unit in a display case. The extra barrel is attached onto and substantially parallel to the barrel of the fully assembled shotgun. In the preferred embodiment, the display clamp is longitudinally split into two halves. The two halves are mirror images that can be bolted together, along their midsections. When joined, the two halves form collars on opposite ends. One collar is designed to snugly fit around the barrel of an assembled shotgun. The second collar has flared ends that guide the second barrel into the clamp.

5 Claims, 3 Drawing Sheets

DISPLAY CLAMP ASSEMBLY FOR EXTRA FIREARM BARRELS

This Utility Patent Application is based upon an earlier Provisional Patent Application Ser. No. 60/652,715, filed Feb. 14, 2005. Applicants claim the benefit of priority from the Provisional Application.

FIELD

The present invention relates to devices and methods for displaying or holding an extra barrel for shotguns and rifles.

BACKGROUND

Some shotguns are sold as combination packs, i.e., a shotgun having two removable barrels. An example of such a shotgun is the 835® Turkey/Deer COMBO model sold by O.F. Mossberg & Sons, Inc. of North Haven, Conn. USA. That model includes a 12 gauge smooth bore barrel for shot shells and a fully rifled barrel for slugs.

It is common practice for retail stores to display an assembled shotgun portion of a combination pack and not the additional barrel. Similarly, the owner of a combination pack will often store a shotgun in a display case at home, with the extra barrel loose inside the case. Sometimes the extra barrels get misplaced, or left behind.

Some owners attach extra barrels, in their display cases, by string or twine. Wouldn't it be nice if there was something sturdier to store the barrels side-by-side, for display and easy retrieval of the extra barrel?

Accordingly, it is a primary object of the present invention to provide a display clamp for attaching a second barrel to a shotgun for display purposes only, allowing a retail store to display the firearm as a combination unit.

It is another primary object to provide a method for attaching a second barrel to a shotgun for display purposes only, allowing a retail store to display the firearm as a combination unit.

It is another object to provide a display clamp which can be used by a firearm owner to store an extra barrel in a display case at home, for display and easy retrieval.

It is yet another object to provide a display clamp which can be expanded to display other accessories on a firearm, such as choke tubes.

SUMMARY OF THE INVENTION

A display clamp assembly, and a related method, are disclosed for removably attaching a second barrel to a shotgun for display purposes, allowing a retail store (or a buyer) to display the firearm as a combination unit. The extra barrel is attached to the barrel of the fully assembled shotgun.

DETAILED DESCRIPTION

FIGS. 1-4 show a preferred embodiment of a display clamp assembly 10 for removably clamping a second barrel 12 onto, and substantially parallel to, a barrel 14 of a fully assembled shotgun. This allows a retail store (or a buyer) to display the firearm as a combination unit.

Display clamp 10 is preferably made of lightweight steel. It comprises two generally mirrored halves 16*a*, 16*b* that bolt together longitudinally to form two collars 18*a*, 18*b* at opposite ends of the clamp 10. Collar 18*a* is designed to fit snugly around barrel 14, while collar 18*b* is designed to fit snugly around extra barrel 12.

Figure 1:
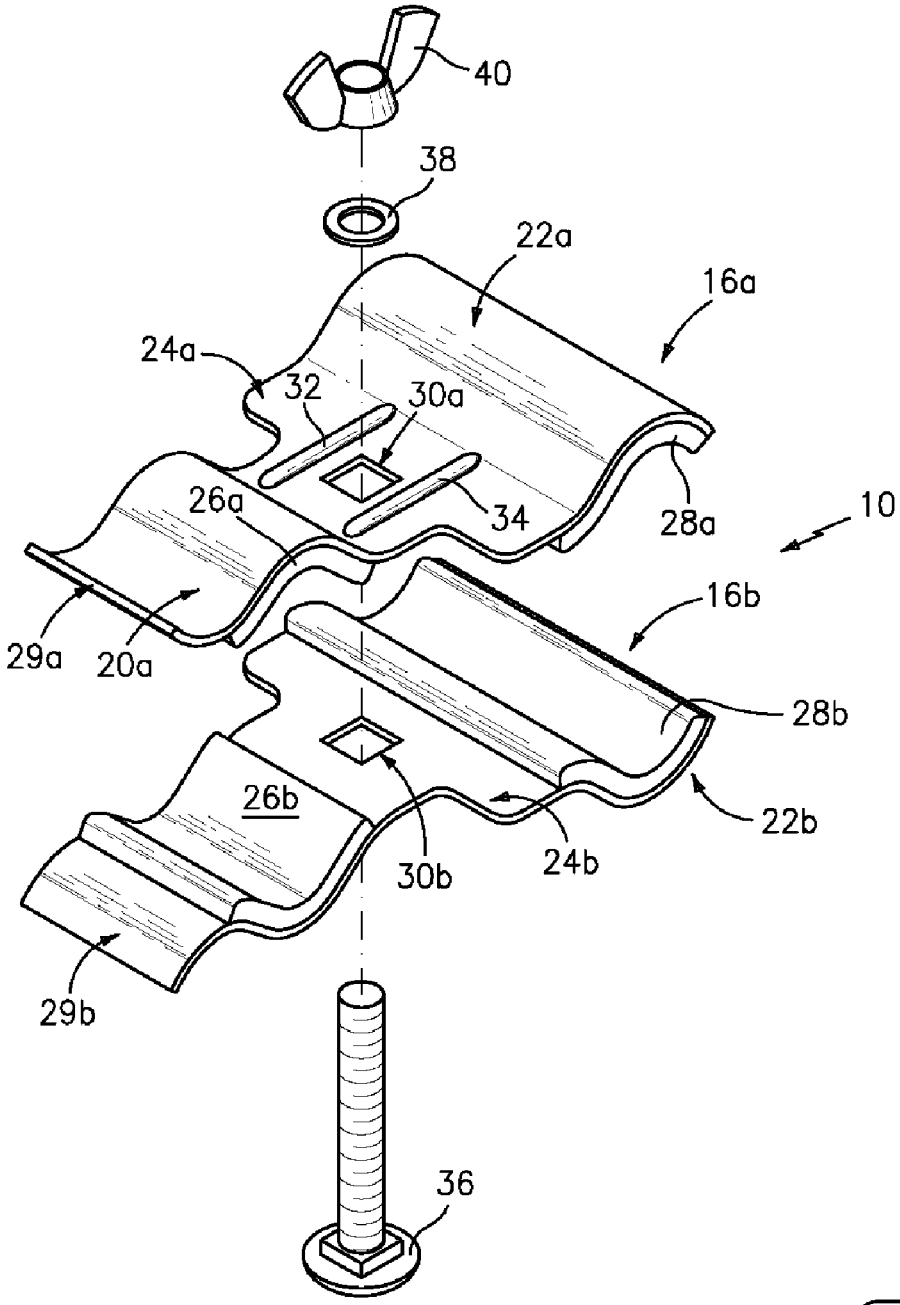
FIG. 1 is an exploded view of a display clamp constructed in accordance with the present invention.
Figure 2:
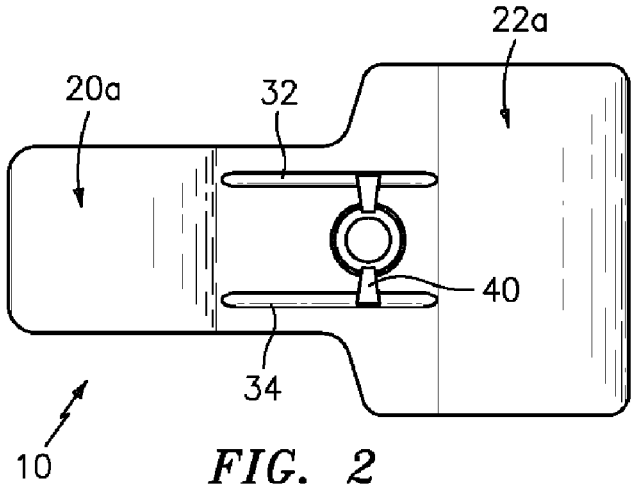
FIG. 2 is a top plan view of the display clamp assembled.
Figure 3:
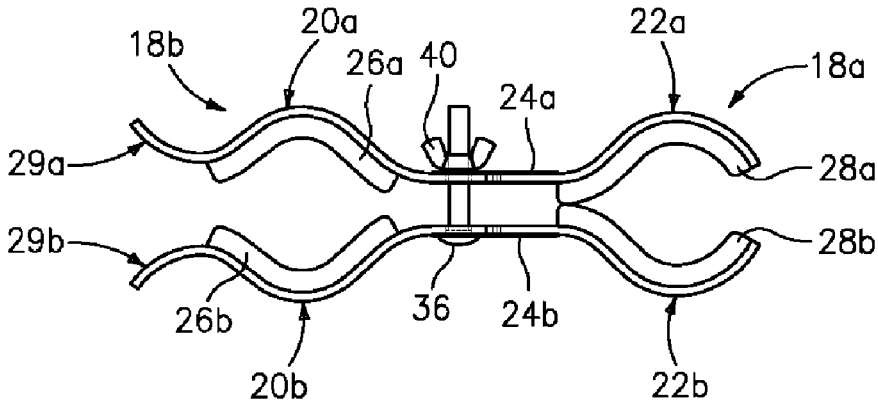
FIG. 3 is a side plan view of the assembled display clamp.

As best shown in FIGS. 1 and 3, clamp half 16*a* is a single piece comprising two arcuate end portions 20*a*, 22*a* connected by a flat midsection or shank 24*a*. End portion 20*a* resembles a stretched "S" shape. Opposite end portion 22*a* is narrower. It is similarly curved but without the top portion of the elongated "S".

Adhered inside both end portions 20*a*, 22*a* are foam pieces 26*a*, 28*a* of equal length, leaving the distal tip 29*a* of portion 20*a* non-foamed. The foam pieces 26*a*, 28*a* are preferably a vinyl nitrile neoprene ("VNN") blend, with permanent adhesive on one side.

Shank 24*a* resembles the metal tip of a seat belt. It has a square throughbore 30*a*.

Clamp half 16*b* has the following parts mirrored to their opposing counterparts in clamp half 16*a*: arcuate end portions 22*b*, 22*b*; shank 24*b*; throughbore 30*b* (which aligns with bore 36*a*); and foam pieces 26*b*, 28*b*. The only difference is that the outside of shank 24*a* has two parallel ridges 32, 34.

In the preferred embodiment, the two halves 16*a*, 16*b* are bolted together by a round square head bolt 36; a washer 38 and a wing nut 40. Ridges 32, 34 help tighten down the wing nut and prevent it from loosening. In addition, the square head of bolt 36 fits securely within square bore 30*b*, which prevents the bolt from rotating.

Figure 5:
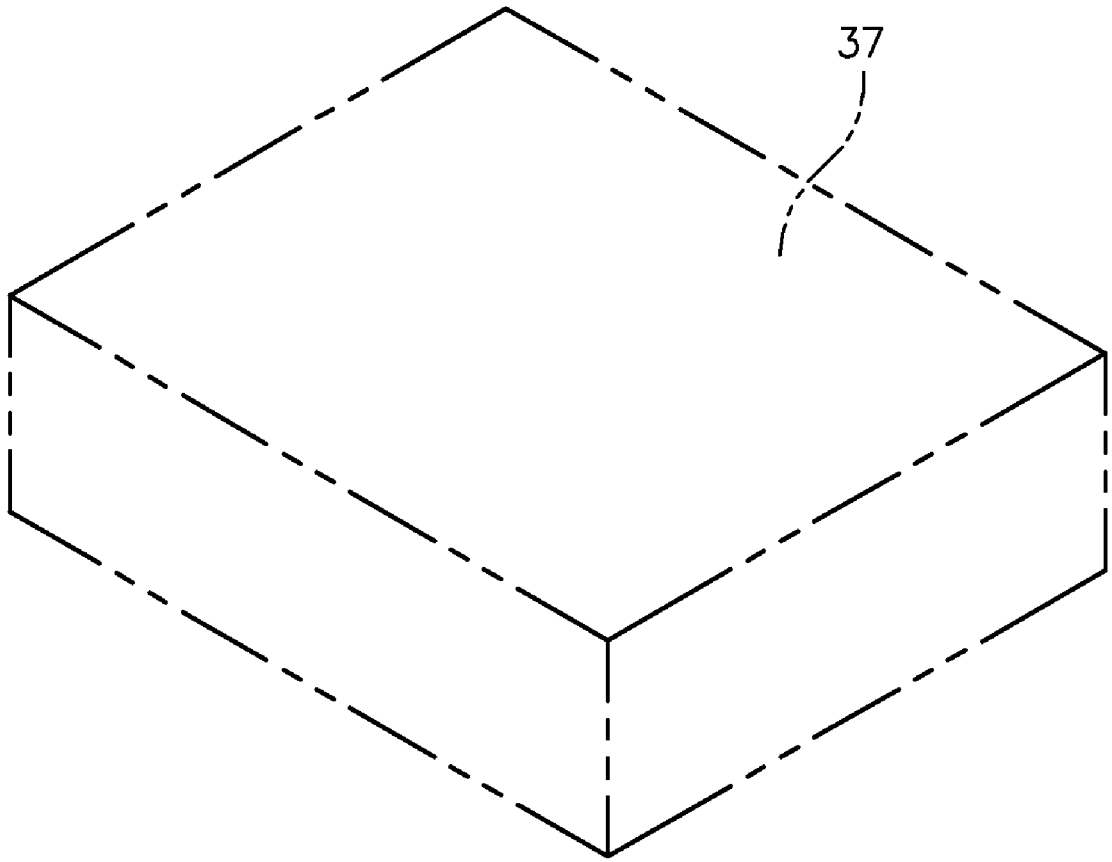
FIG. 5 is a block representing a generic display case for shotguns.

Applicants' preferred display clamp assembly 10 can be thought of as a split clamp assembly. Assembly 10 permits the second barrel (e.g., 12) to be firmly attached onto, suspended from, and generally parallel to, the barrel (e.g., 14) of an assembled shotgun, for storage within a display case 37 (see FIG. 5). This split clamp assembly allows both barrels 12, 14 to be displayed, spaced apart from one another, where they can be seen and easily retrieved.

There is a preferred way of clamping barrel 14 onto, and substantially parallel to, barrel 12 of the assembled shotgun. During this preferred method, the clamp 16*a*, 16*b* halves are first loosely bolted together. Then collar 18*a* (made of end portions 22*a*, 22*b*) is slipped over barrel 14 of the assembled shotgun. Next, the wing nut 40 is tightened down.

When the clamp 10 is assembled onto barrel 14 (see FIG. 4), foam pieces 28*a*, 28*b* inside collar 18*a* mold to the configuration of barrel 14.

Figure 4:
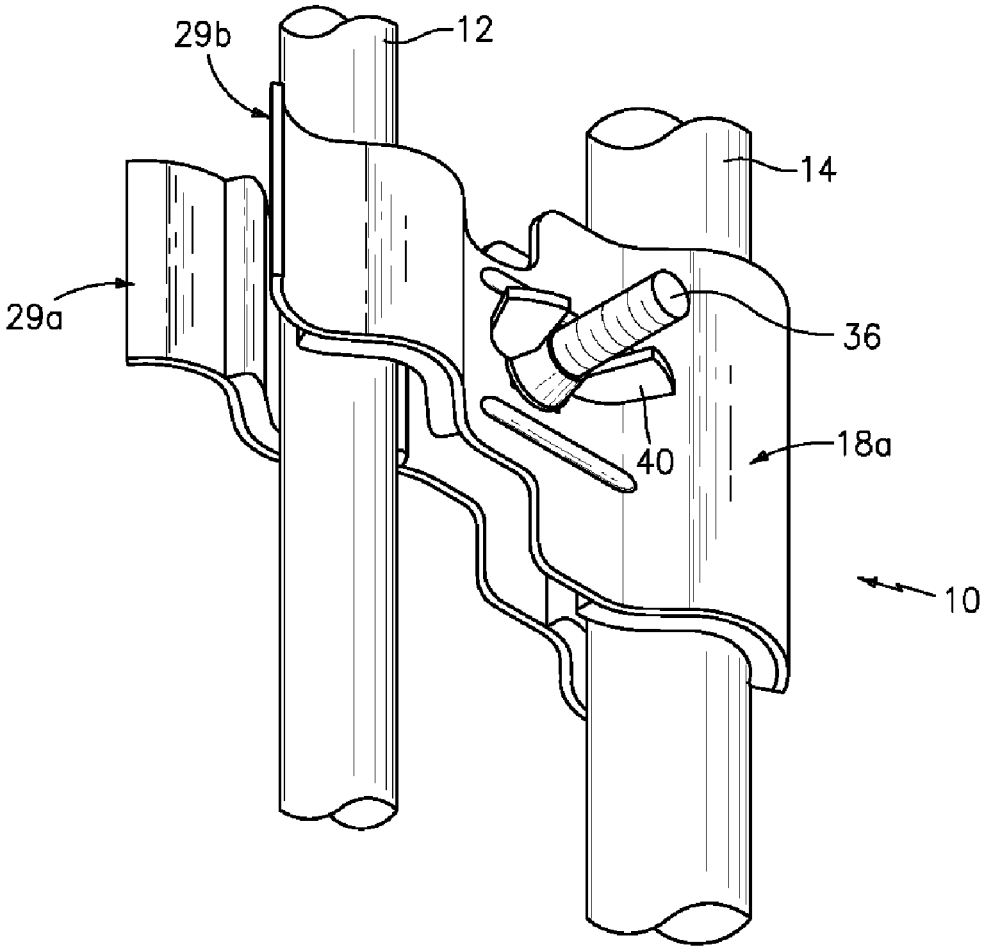
FIG. 4 shows two barrels of a combination pack attached via the display clamp.

Referring to the assembled clamp 10 shown in FIGS. 3 and 4, note that collar 18*a* resembles an oval that is almost totally closed. On the other hand, the distal ends 29*a*, 29*b* of collar 18*b* are not closed. They are purposely spaced apart, and flared outwardly in opposite directions, to form a set of guide arms. The distal ends 29*a*, 29*b* are used to guide the extra barrel 12 into collar 18*b* before the wing nut 40 is tightened down.

While the display clamp 10 is designed to store an extra barrel 12, it could instead, if desired, be used to store a choke tube (not shown) for an attached shotgun.

It should be understood that obvious modifications can be made to the display clamp assembly, or the related method, without departing from the spirit or scope of the invention. For example, the display clamp halves 16*a*, 16*b* could be made of plastic, or a different fastener system (other than bolt 36 and wing nut 40) could be used. Accordingly, reference should be made primarily to the accompanying claims, rather than the foregoing description and drawings, to determine the scope of the present invention.

We claim:

1. A method of displaying a second barrel adjacent a fully assembled shotgun, comprising the steps of:

a. removably clamping the second barrel onto, substantially parallel to, and suspended from, a first barrel of the assembled shotgun by a split clamp assembly; and b. storing the assembled shotgun with the clamped second barrel inside a display case.

2. The method of claim 1 wherein the clamping step comprises:

a. clamping a first collar of the clamp assembly onto the first barrel; and, b. clamping a second collar of the clamp assembly onto the second barrel.

3. The method of claim 2 wherein the clamping step further comprises bolting two substantially mirrored halves of the clamp assembly together.

4. The method of claim 3 further comprising the step of guiding the second barrel into the second collar through flared guide arms.

5. The method of claim 2 further comprising the steps of slipping the first collar over the first barrel, and guiding the second barrel into the second collar through flared guide arms, prior to bolting the two halves of the clamp assembly securely together.

* * * * *